United States Patent [19]

Hayashi et al.

[11] 4,344,011

[45] Aug. 10, 1982

[54] X-RAY TUBES

[75] Inventors: Tadashi Hayashi, Mobara; Setsuo Nomura, Tokyo, both of Japan

[73] Assignee: Hitachi, Ltd., Tokyo, Japan

[21] Appl. No.: 93,268

[22] Filed: Nov. 13, 1979

[30] Foreign Application Priority Data

Nov. 17, 1978 [JP] Japan ..... 53-141157

[51] Int. Cl.[3] ..... H01J 35/00; H01J 29/46

[52] U.S. Cl. ..... 313/57; 313/453

[58] Field of Search ..... 313/453, 57, 55

[56] References Cited

U.S. PATENT DOCUMENTS 2,019,600 11/1935 Ehrke ..... 313/57

FOREIGN PATENT DOCUMENTS 36-23324 of 1961 Japan .
40-1305 of 1965 Japan .
51-35968 of 1976 Japan .
53-30292 of 1978 Japan .

OTHER PUBLICATIONS

Journal of the Japanese Radiation Technical Society, 1977, p. 518.
Sugata, E.; Electron Microscope (2); Published by Ohm Co., 1961, p. 81.
The Encyclopedia of X-Rays and Gamma Rays, Ed. by Clark, G.L., 1968, pp. 1087–1090.

*Primary Examiner*—Ernest F. Karlsen
*Attorney, Agent, or Firm*—Charles E. Pfund

[57] ABSTRACT

In an X-ray tube comprising a cathode electrode including a filament for emitting electrons and a focusing electrode having a focusing groove adapted to contain the filament, and an anode electrode opposing the cathode electrode and maintained at a high potential which is positive relative to the filament, an electron emitting region of the filament facing the anode electrode is formed as a substantially flat surface, and the filament, the focusing electrode and the anode electrode are arranged such that a portion of the anode electrode upon which electron collide will be positioned in a focal plane of a cathode lens formed by the filament, the focusing electrode and the anode electrode.

5 Claims, 11 Drawing Figures

X-RAY TUBES

BACKGROUND OF THE INVENTION

This invention relates to an X-Ray tube which can produce a high brightness with a small focal spot and can be used over a wide operating range.

When using an X-ray tube for taking an X-ray photograph, it is necessary to minimize the size of the focal spot (electron beam spot) of the X-ray tube and to increase the tube current coming into the focal spot, that is, to increase the brightness. Thus, it has long been sought in the art of X-ray tubes to provide a small focal spot, of less than 0.1 mm and at the same time a tube current having a current density of more than twice that of the prior art.

FIG. 1 shows schematically cathode and anode (or target) electrodes of a prior art X-ray tube. As shown, heating current is passed through a helically wound filament coil 2 of a cathode electrode 1 to emit electrons and the electron beam standing for the X-ray tube current is focused by a focusing electrode 3 disposed about the filament to form a focal spot of a predetermined dimension on the surface of an anode or target electrode 4 opposing the cathode electrode 1. With such a prior art construction, so-called main focal spot having a diameter of A and an auxiliary focal spot having a diameter of B are formed on the surface of the target electrode 4 so that it has been extremely difficult to concentrate all electrons emitted from the filament on a small area having a diameter of less than 0.1 mm. The main focal spot is due to a group of electrons emitted from the front surface of the filament confronting the target electrode 4 whereas the auxiliary focal spot is due to a group of electrons emitted from the side surface of the filament 2. The main focal spot and the auxiliary focal spot have opposite behaviors with respect to the parameters that determine the foci. As a consequence, the current density distribution in the foci localizes at opposite ends of the main and auxiliary foci, thus producing four peaks or two peaks (the latter being formed when the main and auxiliary foci coincide with each other). Although it is possible to form a focal spot of less than 0.1 mm by concentrating either one of the main and auxiliary foci to one spot, in such a case the diameter of the other focal spot is broadened, resulting in a three peak distribution.

It will be understood from the foregoing that with the prior art cathode and anode arrangement it is difficult to obtain an extremely small focal spot. As a measure for eliminating the auxiliary focal spot, a cathode electrode structure has been proposed, as disclosed in Japanese Patent Application Laid Open No. 30292/'78, wherein a cathode electrode having one end divided into a main portion and side portions on both sides of the main portion is disposed in a step shaped groove formed in a focusing electrode and a filament is provided beneath the main portion to heat the same. According to this construction, it is possible to eliminate the auxiliary focal spot and to adjust the degree of electron focusing by a variable voltage source connected between the focusing electrode and the main portion. However, as far as prior art focusing electrodes as shown in FIGS. 3 and 4 of the aforementioned laid open patent specification and like the prior art of FIG. 1 of the instant application are concerned, since the image of an electron emitting region is focused on the surface of the anode electrode as will be discussed later in connection with FIG. 5 of the instant application, it is necessary to make extremely small the electron emitting region of the cathode electrode in order to make the diameter of the focal spot be less than 0.1 mm. However, such a construction decreases the magnitude of the X-ray tube current, thus limiting the field of application of the X-ray tube.

Another method of decreasing the effect of the auxiliary focal spot is disclosed on page 518 of the Journal of the Japanese Radiation Technical Society, 1977 in which the lens action of the focusing electrode is strengthened to reduce the diameter of the main focal spot below 0.1 mm, as in the well known zero bias type cathode electrode structure and the electron emission from the side surface of the filament which forms the auxiliary focal spot is restricted by a space charge effect so as to sufficiently increase only the main focus current density. This method, however, relies upon the space charge effect so that a desired small focal spot can be obtained only in a range of specific operating conditions. Thus, for example, when the operating voltage or tube current is varied, it is often impossible to obtain a desired small focal spot.

In the prior art fine focus X-ray tubes, since the lens action of the focusing electrode is generally strengthened, the electrons are liable to be influenced by the space charge effect so that the electrons emitted from the filament are difficult to flow towards the anode electrode with the result that the tube current supplying capability of the cathode electrode is limited to a relatively small value relative to the current receiving capability of the anode electrode, thereby degrading the quality of the X-ray tube and limiting the field of application thereof.

SUMMARY OF THE INVENTION

Accordingly, it is an object of this invention to provide an improved X-ray tube capable of eliminating various difficulties encountered in the prior art fine focus X-ray tube, capable of providing a small focal spot and at the same time a sufficiently large electron current density, i.e. high brightness to follow increased current receiving capability of the anode electrode over a wide range of operating condition, and capable of forming a single peak electron current density distribution at a site of the anode electrode upon which electrons collide.

According to this invention, there is provided an X-ray tube comprising a cathode electrode including a filament for emitting electrons and a focusing electrode having a focusing groove adapted to contain the filament, and an anode electrode opposing the cathode electrode and maintained at a high potential which is positive relative to the filament, wherein an electron emitting region of the filament facing the anode electrode is formed as a substantially flat surface, and wherein the filament, the focusing electrode and the anode electrode are arranged such that a portion of the anode electrode upon which the electrons collide will be positioned in a focal plane of a cathode lens formed by the filament, the focusing electrode and the anode electrode.

DESCRIPTION OF THE PREFERRED EMBODIMENTS

Figure 1:
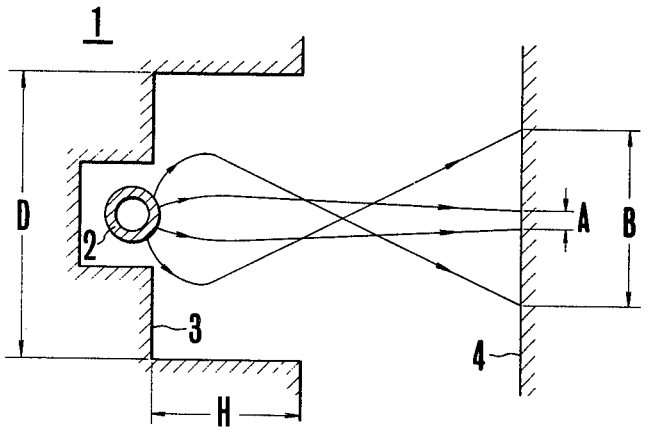
FIG. 1 (PRIOR ART)
FIG. 1 is a diagrammatic representation showing the manner of electron current focusing of a prior art X-ray tube.
Figure 2:
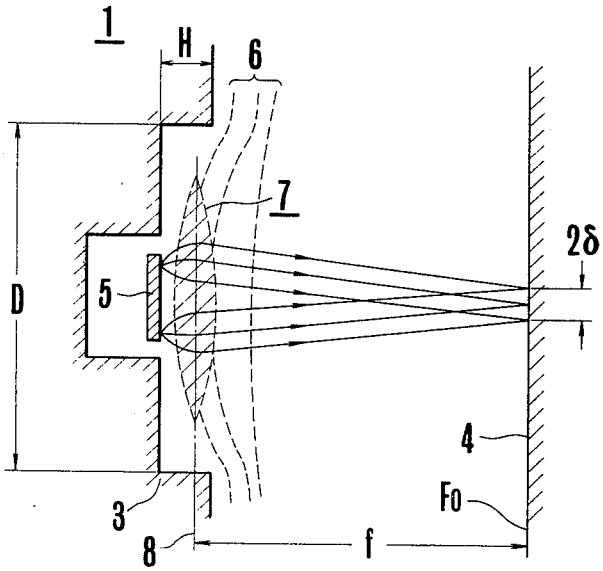
FIG. 2 is a similar diagrammatic representation showing the manner of electron current focusing of an X-ray tube embodying the invention.

Although the detail of the construction of a filament 5 shown in FIG. 2 will be given later, the filament 5 is generally shaped such that the amount of electrons emitted from the side surfaces is negligibly smaller than that emitted from the plane shaped electron emission region confronting the anode electrode 4. The depth H of the focusing groove of the focusing electrode 3 of this invention is determined by an electronic computer such that the focal plane of a cathode lens formed by the focusing electrode coincides with the surface of the anode. As described above, the depth H is made to be smaller than that of the prior art construction shown in FIG. 1 so that the radius of curvature of the equipotential surfaces 6 at the focusing groove is smaller than that of the prior art construction and the focusing function of an electrostatic lens, that is, the cathode lens 7 formed by these equipotential surfaces is far weaker than that of the prior art cathode lens. The portion of the anode electrode 4 upon which electrons collide coincides with a focal plane F0 of the cathode lens 7 or is located at a position distant from the main plane of the cathode lens 7 by the focal distance f of the lens. According to the description on page 81 of Eiji Sugata "Electron Microscope (2)", published by Ohm Co., 1961, the size $2\delta$ of the electron beam spot on the focal plane of the cathode lens is expressed by the following first-order approximation equation.

$$\partial = f \cdot \sqrt{\epsilon / Va}$$

where $\epsilon$ represents the initial velocity energy of electrons, Va the acceleration energy, and f the focal length of the cathode lens. Taking $\epsilon = 0.2$ eV, Va = 100 KeV and f = 10 mm, an electron beam spot having a diameter of 0.028 mm can theoretically be obtained with the anode electrode of this invention.

Comparing the focusing groove of this invention with a conventional one, the depth H of the groove is only about 1 to 2 mm according to this invention, whereas about 5 mm according to the prior art construction where a single step groove having a width of 8 mm is used for both cases. Thus, one of the features of this invention lies in the use of a cathode lens having an extremely weak focusing action. The reason therefor will be described hereunder with reference to FIGS. 3 and 4.

Figure 3:
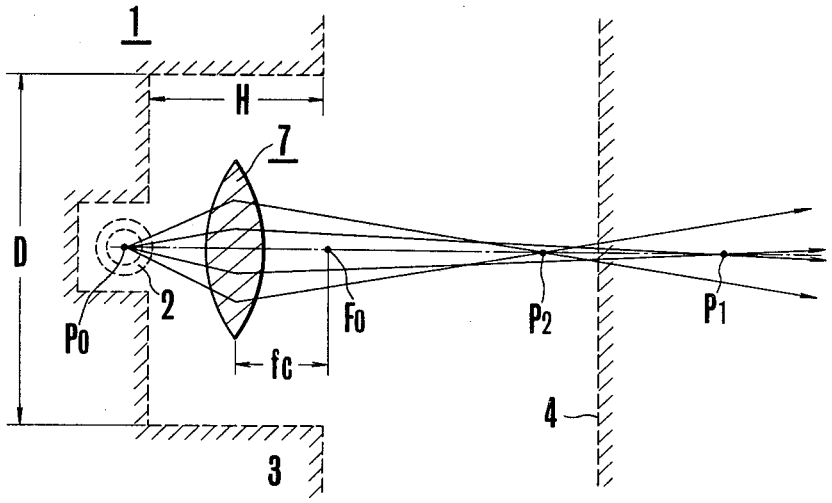
FIG.3 (PRIOR ART)
FIG. 3 is a diagrammatic representation useful to explain the manner of electron current focusing of the prior art X-ray tube.

FIG. 3 shows a manner of focusing an electron current with a cathode lens of a prior art X-ray tube. Denoting by P0 the position where electrons are assumed to be emitted, e.g, the position of an imaginary electron source, as can be noted by comparing FIGS. 1 and 3, the anode electrode 4 of prior art X-ray tube is positioned at an intermediate point between an image position P1 of the imaginary electron source formed by the electrons emitted from the front surface of the filament 2 and the image position P2 of the imaginary electron source formed by the electrons emitted by the side surfaces of the filament 2. If the cathode lens 7 has no spherical aberration, positions P1 and P2 would coincide with each other so that the anode electrode 4 would be located at the position of the image of the imaginary electron source. In other words, in the prior art X-ray tube, the anode electrode was not positioned at the position F0 of the focal plane of the cathode lens 7 but at the position of the image of the filament 2 formed by the cathode lens 7. For this reason, it has been necessary to make sufficiently short the focal length fc of the cathode lens 7. In other words, the focal plane F0 is closer to the focusing electrode 3 than to the anode electrode 4.

Figure 4:
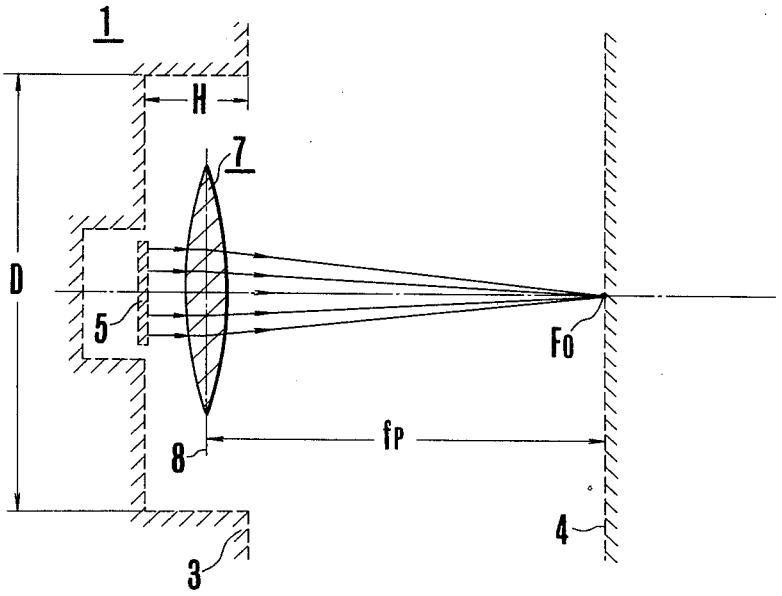
FIG. 4 is a similar diagrammatic representation useful to explain the manner of electron current focusing of the X-ray tube embodying the invention.

On the other hand, in the X-ray tube of the present invention, the anode electrode 4 is located on the focal plane F0 as shown in FIG. 4. As described above, since the main plane of the cathode lens 7 is located near the filament, it is necessary to increase the focal length fP of the cathode lens 7 to a length substantially equal to the distance between the anode electrode 4 and the filament 5. In the other words, the condition necessary to realize the electro-optical structure shown in FIG. 4 is the increase in the focal distance, that is, extreme decrease in the cathode lens action.

The fact that, according to this invention, a plane shaped filament is not simply substituted for a helical coil filament of the prior art X-ray tube can be clearly understood from the above-described principle of this invention and from the difference in the construction in which the electron focusing force of the focusing electrode is weakened.

Figure 5:
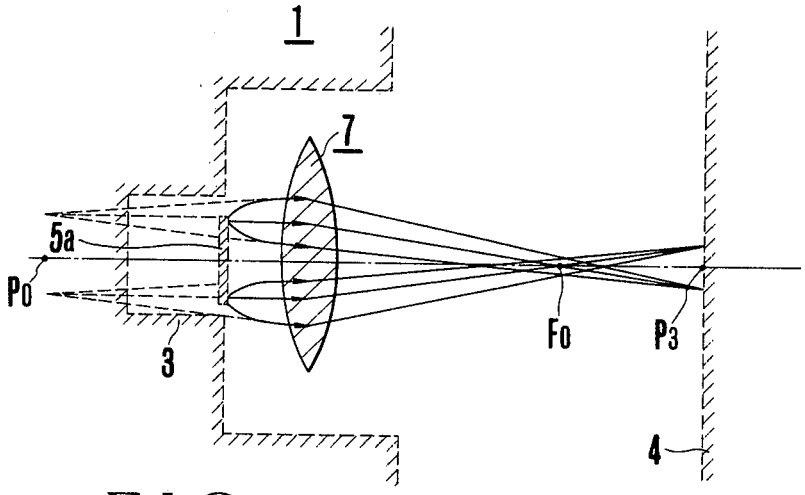
FIG. 5 is a diagrammatic representation showing the manner of focusing with a conventional focusing electrode having a strong focusing action upon electrons emitted by a cathode electrode having a plane shaped electron emitting region.

Then, the description regarding the difference in the effect will be described hereunder. FIG. 5 shows an electro-optical light path of an X-ray tube (hereinafter termed X-ray tube A) which utilizes a plane shaped filament 5*a* and in which the lens action of the cathode lens 7 is strengthened in the same manner as in the prior art X-ray tube and the anode electrode 4 is located on the image plane of the filament. In the X-ray tube of FIG. 5, the position P0 of the imaginary electron source is located behind the filament and spaced therefrom by a distance determined by the electric field intensity at the filament surface and a velocity component of the emitted electrons parallel to the filament surface, and the size of the imaginary electron source is the same as that of the filament 5*a*. This fact can readily be understood from the Sugata "Electron Microscope (2)" described above. The size of the beam spot at the position of the anode electrode 4, that is, the size of the filament image is expressed as follows:

$$d1 = d0 \times M$$

where d0 represents the size of the filament, and M the magnifying power of the cathode lens.

As has been pointed out, in the X-ray tube of this invention, the size of the beam spot can not be reduced beyond 0.028 mm, where $\epsilon$ is 0.2 eV, Va is 100 KV and f is 10 mm. In the X-ray tube of FIG. 5, as the size of the beam spot can be expressed by equation (2) by the first-order approximation, it is possible to decrease the size of the beam spot beyond 0.028 mm by decreasing the size of the filament, for example. However, decrease in the filament size results in the decrease in the tube current. Where the anode electrode 4 is disposed on the focal plane F0 as in this invention, it is evident from the principle that it is impossible to reduce the size of the beam spot to be smaller than 0.028 mm. However, as the beam spot size is almost independent of the size of the filament, it is possible to produce larger tube current, thus attaining a desired object of obtaining a beam spot having a diameter of less than 0.1 mm and yet providing an excellent tube current load characteristic. Where a fine focus of less than 0.1 mm is not necessary, even in the X-ray tube of FIG. 5, it is possible to provide a beam spot having an excellent tube current load characteristic and a uniform focus current intensity distribution including only one peak since it is possible to use a large cathode electrode. As can be noted by the comparison with FIG. 1, in the X-ray tube shown in FIG. 5 and utilizing plane shaped filament, this excellent characteristic can be attributable to the collimated emission of the electrons. The quality of the X-ray photographs obtained by a beam spot having a single peak or similar distribution is much higher than those obtained by a beam spot having substantially the same size but having multiple peaks.

Figure 6:
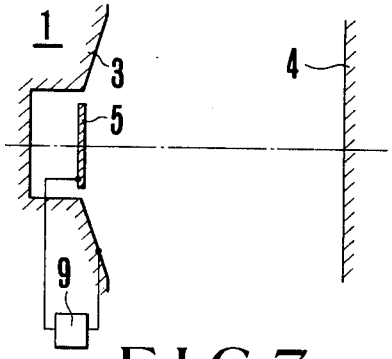
FIG. 6 is a diagrammatic representation to show a method of electrically adjusting the focal distance of a cathode lens according to this invention.
Figure 7:
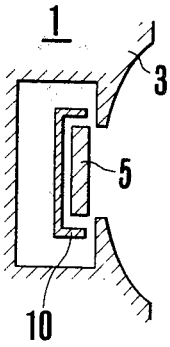
FIGS. 7 and 8 are diagrammatic representations showing electrode arrangements for applying positive voltage upon the focusing electrode.
Figure 8:
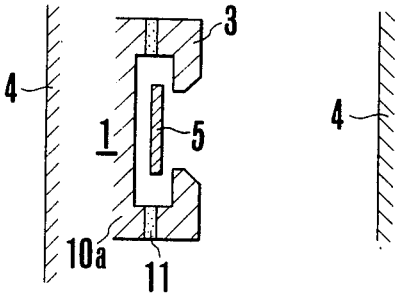

In the X-ray tube according to this invention, when a variable voltage source 9, FIG. 6, is connected between the focusing electrode 3 and the filament 5 to adjust the focal length of the cathode lens by varying the voltage of the source, it is possible to compensate for the errors caused by mechanical machining so that the anode electrode 4 can be readily positioned on the focal plane of the cathode lens. As the focal length of the cathode lens is increased, in certain cases, it is necessary to apply a positive voltage upon the focusing electrode 3 with respect to the filament 5. Where the value of the positive voltage reaches 1 KV for the purpose of compensating for the errors caused by mechanical machining, the electrons emitted by the filament 5 would impinge upon the surrounding focusing electrode 3, thus heating the same. This can be prevented by providing an electrode insulated from the focusing electrode at a point closely surrounding portions other than the electron emitting region of the filament 5 facing the anode electrode 4, and by applying to this electrode a potential equal to or substantially equal to the filament potential. Thus, a potential close to that of the filament potential is applied to an electrode 10 shown in FIG. 7 or an electrode 10*a* shown in FIG. 8. In FIG. 8, reference numeral 11 represents an insulator.

Figure 9:
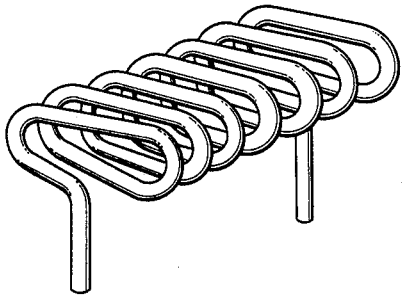
FIGS. 9, 10 and 11 are perspective views showing a plane shaped electron emitting region of the X-ray tube embodying the invention.
Figure 10:
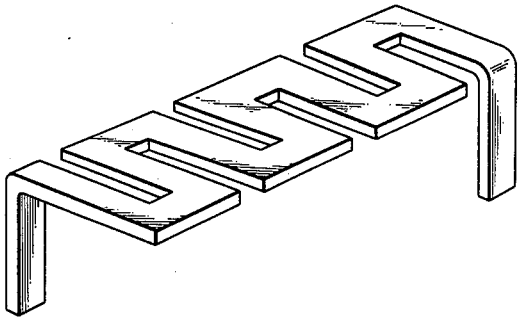
Figure 11:
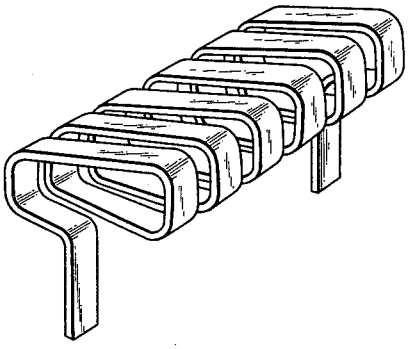

The filament having a substantially plane electron emission region and utilized in the X-ray tube of this invention is preferred to be a thin flat plate. In the example shown in FIG. 9, a fine heat resistant metal wire is wound into a flat helical coil and the surface of the coil confronting the anode electrode is made flat. In the example shown in FIG. 10, a flat strip of heat resistant metal is shaved into a wavy configuration with its one surface confronted to the anode electrode. Further, in the example shown in FIG. 11, a strip of a heat resistant metal is wound helically into a coil with one flat surface thereof faced to the anode electrode. With these examples, it is possible to manufacture filament coils having small end cooling effect. These flat filament coils having larger flat surface than the side surface can uniformly emit electrons toward the anode electrode, the auxiliary focal spot does not appear and a beam spot can be produced on the anode electrode in which the current density distribution is uniform and resembles a single peak distribution. Thus, it is possible to obtain a beam spot of small diameter which greatly improves the quality of the image of the X-ray photographs. In any type of the filament, when it is maintained for a long time at a high temperature necessary to emit a large number of electrons, the filament will be worn out by evaporation so that it is heated only when the X-rays are irradiated and the temperature is decreased during idle time. The filament is heated by directly passing current therethrough. Each of the illustrated filaments of this invention has larger effective electron emission area than that of the conventional coil filament shown in FIG. 1, thus producing larger X-ray tube current.

As described above, the invention provides an improved X-ray tube capable of producing a large X-ray tube current with a small focal spot over a wide range of the operating conditions and in which the current density distribution of the beam spot on the anode electrode is uniform like a single peak distribution, thus improving the quality of the X-ray photographs.

What is claimed is:

1. An X-ray tube for producing a minute focused spot of high current density comprising a cathode electrode including a filament for emitting electrons and a focusing electrode having a focusing groove adapted to contain said filament, and an anode electrode opposing said cathode electrode adapted to be maintained at a high potential which is positive relative to said filament, wherein a relatively large electron emitting region of said filament facing said anode electrode is formed as a substantially flat surface, and wherein said filament is disposed at a predetermined depth of said focusing groove, the depth being determined as relatively small compared to the width of said focusing groove, a portion of said anode electrode upon which electrons collide being positioned in a focal plane of a cathode lens which is formed by said filament, said focusing electrode and said anode electrode, said cathode lens having a weak focusing action with a focal length substantially equal to the distance between said anode electrode and said filament to produce a minute focused spot of high current density.

2. An X-ray tube according to claim 1 which further comprises a variable voltage source connected between said focusing electrode and said filament so as to position said electron collision portion of said anode electrode in the focal plane of said cathode lens.

3. An X-ray tube according to claim 1 wherein said filament comprises a helical coil of a heat resistant metal wire with one surface of the coil facing said anode electrode flattened and wherein said coil is directly supplied with current to be heated.

4. An X-ray tube according to claim 1 wherein said filament is made of a heat resistant metal strip which is heated by directly passing current therethrough, said filament having a flat surface opposing said anode electrode.

5. An X-ray tube according to claim 2 which further comprises another electrode disposed to closely surround the periphery of said filament other than the electron emitting region thereof facing said anode electrode, said another electrode being electrically insulated from said focusing electrode, and means for applying to said another electrode a potential equal to or substantially equal to filament potential.

* * * * *

UNITED STATES PATENT AND TRADEMARK OFFICE

CERTIFICATE OF CORRECTION

PATENT NO. : 4,344,011

DATED : August 10, 1982

INVENTOR(S) : Tadashi Hayashi and Setsuo Nomura

It is certified that error appears in the above—identified patent and that said Letters Patent is hereby corrected as shown below:

Column 3, line 59, "$\partial = f \cdot \sqrt{\varepsilon/Va}$" should read --

$\delta = f \cdot \sqrt{\varepsilon/Va}$ --.

Signed and Sealed this

*Fifth* Day of *October 1982*

[SEAL]

*Attest:*

GERALD J. MOSSINGHOFF

*Attesting Officer*

*Commissioner of Patents and Trademarks*